US007201571B2

(12) United States Patent
Graefe et al.

(10) Patent No.: US 7,201,571 B2
(45) Date of Patent: Apr. 10, 2007

(54) METHOD FOR EXTRUSION AND EXTRUSION PLANT, IN PARTICULAR FOR PRODUCTION OF BENT EXTRUDED PRODUCTS

(75) Inventors: Joachim Graefe, Schwerte (DE); Uwe Muschalik, Duisburg (DE)

(73) Assignee: SMS Eumuco GmbH, Leverkusen (DE)

( * ) Notice: Subject to any disclaimer, the term of this patent is extended or adjusted under 35 U.S.C. 154(b) by 283 days.

(21) Appl. No.: 10/471,033

(22) PCT Filed: Feb. 21, 2002

(86) PCT No.: PCT/DE02/00628

§ 371 (c)(1),
(2), (4) Date: Sep. 26, 2003

(87) PCT Pub. No.: WO02/072292

PCT Pub. Date: Sep. 19, 2002

(65) Prior Publication Data

US 2004/0080076 A1 Apr. 29, 2004

(30) Foreign Application Priority Data

Mar. 8, 2001 (DE) ..... 101 11 062

(51) Int. Cl.
*B29C 53/02* (2006.01)
*B29C 47/12* (2006.01)

(52) U.S. Cl. ..... 425/325; 425/377; 425/380; 425/404

(58) Field of Classification Search ..... None
See application file for complete search history.

(56) References Cited

U.S. PATENT DOCUMENTS

| | | | | |
|---|---|---|---|---|
| 2,422,953 | A * | 6/1947 | Davies et al. | 264/211.12 |
| 3,425,092 | A * | 2/1969 | Taga | 425/192 R |
| 3,490,113 | A * | 1/1970 | Bulck et al. | 425/172 |
| 3,748,077 | A * | 7/1973 | Williams et al. | 425/317 |
| 4,906,171 | A * | 3/1990 | Miller | 425/131.1 |
| 4,929,167 | A * | 5/1990 | Pepper | 425/325 |
| 5,424,023 | A * | 6/1995 | Riley et al. | 264/560 |
| 5,520,870 | A * | 5/1996 | Allan et al. | 264/210.2 |
| 6,190,595 | B1 * | 2/2001 | Thoms et al. | 264/177.16 |
| 6,309,588 | B1 * | 10/2001 | Powell et al. | 264/570 |
| 2004/0201126 | A1 * | 10/2004 | Jakoby et al. | 264/177.16 |

FOREIGN PATENT DOCUMENTS

| | | |
|---|---|---|
| DE | 197 16 292 | 10/1998 |
| EP | 0 706 843 | 4/1996 |
| JP | 02137612 | 5/1990 |
| JP | 03047615 | 2/1991 |
| JP | 06015372 | 1/1994 |
| WO | WO 93/25372 | 12/1993 |

* cited by examiner

*Primary Examiner*—Mark Eashoo
(74) *Attorney, Agent, or Firm*—Andrew Wilford

(57) ABSTRACT

The invention relates to a method for extrusion, in particular for the production of bent extruded products, in which the extruded product (8) is formed in a die mounted before a support yoke (2) of an extrusion machine and then bent or curved by means of the effects of an external force, whereby at least one bending radius is formed, within the support yoke, on the extruded product (8) which enters the support yoke (2) with a straight extrusion direction (4). An extrusion unit further comprises a support yoke (2) formed with a lateral yoke opening (3), running transverse to the straight extrusion direction (4).

3 Claims, 2 Drawing Sheets

METHOD FOR EXTRUSION AND EXTRUSION PLANT, IN PARTICULAR FOR PRODUCTION OF BENT EXTRUDED PRODUCTS

CROSS REFERENCE TO RELATED APPLICATIONS

This application is a national stage of PCT/DE02/00628 filed 21 Feb. 2002 and based upon German national application 101 11 062.6 of 8 Mar. 2001 under the International Convention.

FIELD OF THE INVENTION

The invention relates to a method and apparatus for extruding, in particular for making a curved extrusion, the extrusion being created in a die mounted in a counter beam of an extruder and then being curved or bent by action of an outside force.

BACKGROUND OF THE INVENTION

In order to produce the curved or bent extruded profiles, typically of aluminum or magnesium alloy, required in various industrial settings for various purposes it is known from EP 0,706,843 in extruders of hollow workpieces with wide variance in wall thicknesses to exert by means of a pusher a force at a predetermined distance from the die outlet or counter beam on the strand such that there is an effect on the profile exiting from the extruder die. The pusher can be a pusher roller, a transversely effective slide surface, or even a roller cage. Regardless what kind of pusher is used, a space must be left for return action so that the extruded workpiece can immediately or almost immediately after being extruded and bent or curved and in this manner the workpiece cross section produced by the extruder die does not move parallel to the die but at an angle thereto.

OBJECT OF THE INVENTION

It is an object of the invention to produce a method and an extruder of the above-described type that allow one in a simple manner to produce extrusions of widely varying bend radii.

SUMMARY OF THE INVENTION

This object is achieved according to the invention with a method wherein the extrusion exiting the counter beam in a straight extrusion direction is imparted at least one bend radius right in the counter beam. Since the curves or radii are directly formed after entry of the extrusion into the counter beam, it is possible—without having to provide a curved formation in the die—to achieve very small radii because the extrusion is immediately deflected.

According to a proposal of the invention press phases with straight-line extrusion are alternated with press phases in which the extrusion is bent. This makes it possible, for example, to produce motor-vehicle frame parts and thus advantageously produce different radii of curvature. After extrusion of a straight section the extrusion is pushed to the side with only a more or less large outside force so that a first bend radius is produced, after which the strand is extruded some more before another bend radius is formed. The spacing of the straight extrusion and the force application or bending or curving the extrusion can be controlled by the main controller of the extruder.

An extruder for achieving the objects of the invention has a counter beam formed with a beam opening directed transversely of the straight extrusion direction. This need only open to one side of the beam and produces the necessary clearance for the extrusion to be deflected right in the counter beam and provided with the desired bend radius.

According to an embodiment of the invention the transverse opening has an integrated actuator. This can for example be a pressure-actuated cylinder or the like with a pusher head on a piston rod engaging from the side opposite the beam opening. In order to produce the desired bending or extrusion arc, relatively small forces are needed when extruding aluminum.

When according to the invention the counter beam is many times higher than it is wide and has two columns, a very wide range of different and in particular very small radii can be produced. Since as a result of the excessively tall, that is long and narrow, counter beam, after a first bending it is possible to produce another bend, so long as the bent section of the extrusion in this system only travels through a small distance to exit the lateral opening.

According to an embodiment of the invention, an abutment faces the actuator. The abutment, which is underneath the path of travel of the extrusion, can preferably be a roller an another abutment having a rounded surface engaging the extrusion. This abutment also serves with a rounded surface of a greater or smaller diameter to affect the extrusion bend radius.

BRIEF DESCRIPTION OF THE DRAWING

Further features and particularities of the invention are seen in the claims and the following description of embodiments of the invention shown very schematically in the drawing. Therein:

SPECIFIC DESCRIPTION

Figure 1:
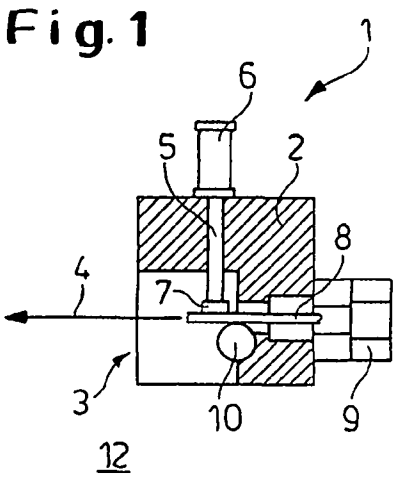
FIGS. 1 to 5 are detail cross-sectional views through counter beams in different phases of the production of curves or bend radii in an extrusion.

A standard extruder 1 shown in the drawing has a counter beam 2, 102, or 202 (see FIGS. 6*a*, 6*b*, and 7*a*, 7*b*). These each have a transverse opening 3, 103, or 203 that opens crosswise to a straight extrusion direction 4 from the beam.

FIGS. 1 to 5 show that the transverse beam opening 3 is provided with an actuator 6 having a piston rod 6 projecting up to the opening 3 in the beam 2. It can act with a pusher head 7 on an extrusion 8 that exits on the inlet side of the beam 2 from a tool carrier 9 with a pusher plate. An abutment 10 provided in the counter beam 2 below the path of the extrusion 10 and formed as a roller is effective opposite to the actuator 6 when this presses with its piston rod 4 and pusher head 7 on the extrusion 8.

Figure 2:
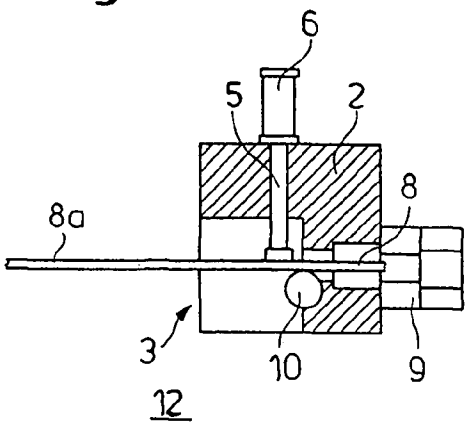
Figure 3:
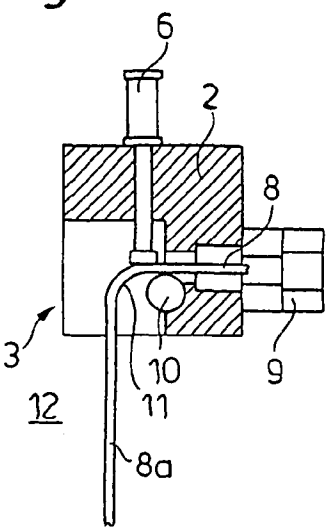
Figure 4:
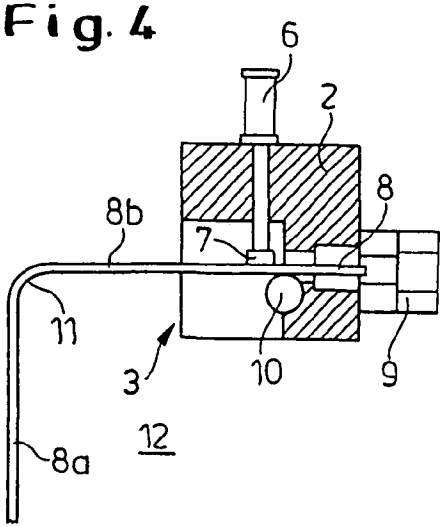
Figure 5:
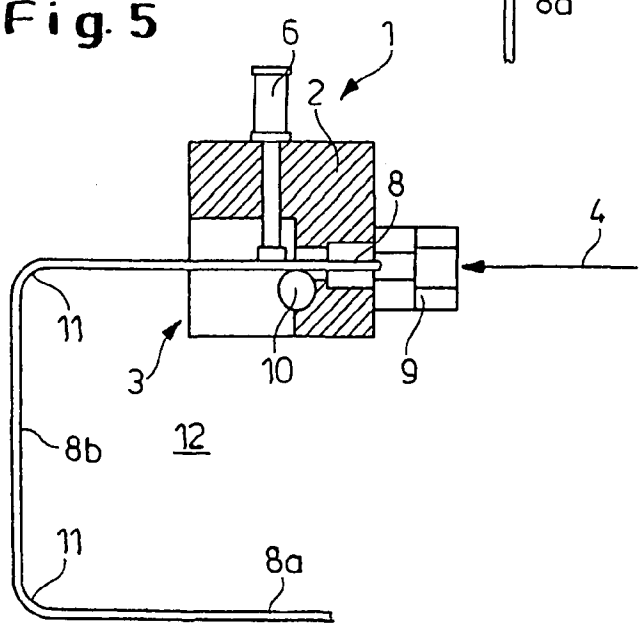
Figure 6A:
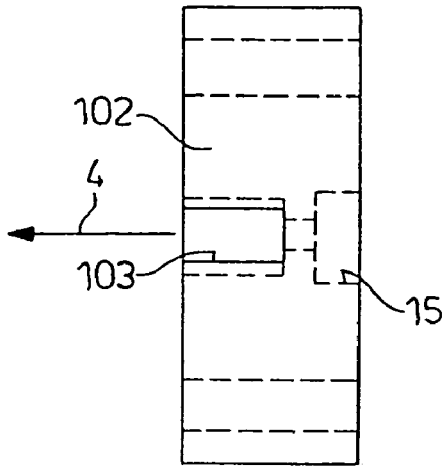
FIGS. 6*a* and 6*b* are detail views of an extruder in side view (FIG. 6*a*) and front view (FIG. 6*b*) of another counter beam.
Figure 6B:
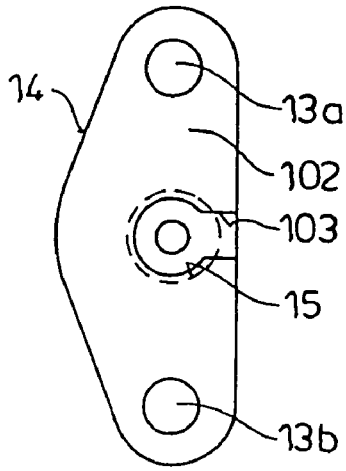

The extrusion 8 is as shown in FIGS. 1 and 2 extruded normal, that is straight, to start with until a leading extrusion portion 8*a* (see FIG. 2) has reached a desired length in the direction 4. Then the actuator is effective against the extrusion 8 so that the extrusion is formed with a curve or bend radius 11 (see FIG. 3). The extrusion 8 or 8*a* meanwhile is supported on a table 12 of the output of the extruder 1. By alternating straight-line extrusion and actuation of the actuator 6 to form a curve after extrusion of another straight extrusion portion 8*b* (see FIG. 4) on the same extrusion 8, a further bend radius 11 shown in FIG. 5 is formed, so that in this manner extrusions with more than one bend can be made from the same extrusion 8.

The counter beams 102 and 202 according to respective FIGS. 6*a*, 6*b* and 7*a*, 7*b* are characterized by a very long and narrow shape with a much greater beam height. The counter beams 102 and 202 are in this embodiment provided with two columns 13*a* and 13*b*. The lateral beam openings 103 and 203 are as a result of the narrow shape very short to their lateral mouth (see FIGS. 6*b* and 7*b*) so that succeeding bends can be made on the same extrusion at short spacings. In order to be able to withstand the extrusion forces the counter beams 102 and 202 are reinforced by a thickened region 14 on their side opposite the transverse beam openings 103 and 203.

Figure 7A:
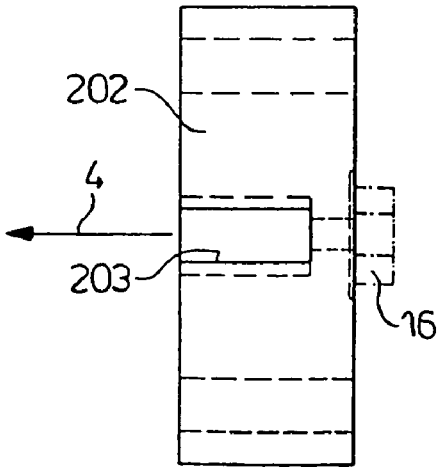
FIGS. 7*a* and 7*b* are side (FIG. 7*a*) and front (FIG. 7*b*) views of a variant of the counter beam according to FIGS. 6*a* and 6*b*.
Figure 7B:
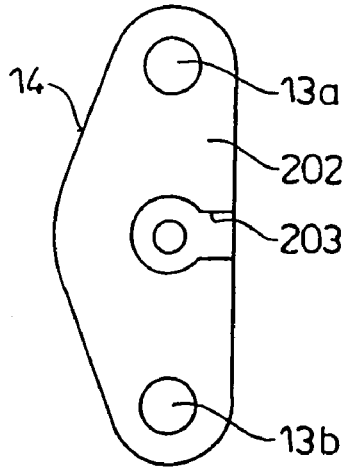

The means bending the extrusion are not shown in the drawing for the counter beams 102 and 202. While with the counter beam 102 the pusher plate of the tool support 9 (see FIG. 1) extends into a beam cutout 15, the dot-dash pusher plate 16 in the embodiment of FIGS. 7*a* and 7*b* is on the upstream side of the counter beam 202. The dimension of the lateral beam opening 203 in the extrusion direction 4 can be bigger than the embodiment of FIG. 6*a* with otherwise similar dimensions.

All embodiments with a transverse beam opening of the counter beam have in common that they accommodate extrusions of different bend radii or curvatures in the counter beam.

The invention claimed is:

1. A extrusion system for making a curved extrusion, the system comprising:

an extrusion die shaped to mold an extrusion forced through the die from one side to an opposite side;

an extruder counter counter beam directly engaging and supporting the die on the other side and formed of one piece with a passage extending transversely to a straight extrusion direction through the die; and an actuator directly engaging and supported on the one-piece counter beam and engaging the extrusion as the extrusion enters the passage for applying a force to the extrusion in a direction transverse to the straight direction to thereby bend the extrusion and form at least one bend radius in the extrusion in a part thereof within the counter beam.

2. The extrusion system defined in claim 1 wherein the counter beam has a height which is multiple of the width of the counter beam and is provided with a pair of columns.

3. The extrusion system defined in claim 1 further comprising a roller in the passage adjacent the die and around which the extrusion is bent, the actuator including a piston pressing the extrusion against the roller.

* * * * *